US011681258B2

(12) United States Patent
Subramanian

(10) Patent No.: US 11,681,258 B2
(45) Date of Patent: Jun. 20, 2023

(54) TIME DISPLAY APPARATUS FOR MULTIPLE TIME ZONES

(71) Applicant: LAW OFFICE OF JERRY JOSEPH, PLC, Washington, DC (US)

(72) Inventor: Navaneeth Krishnan Subramanian, Washington, DC (US)

( * ) Notice: Subject to any disclaimer, the term of this patent is extended or adjusted under 35 U.S.C. 154(b) by 126 days.

(21) Appl. No.: 16/637,260

(22) PCT Filed: Feb. 6, 2020

(86) PCT No.: PCT/US2020/017078
§ 371 (c)(1),
(2) Date: Feb. 6, 2020

(87) PCT Pub. No.: WO2020/190418
PCT Pub. Date: Sep. 24, 2020

(65) Prior Publication Data

US 2021/0364990 A1 Nov. 25, 2021

Related U.S. Application Data

(60) Provisional application No. 62/802,025, filed on Feb. 6, 2019.

(51) Int. Cl.
*G04B 19/22* (2006.01)
*G04B 13/00* (2006.01)
(Continued)

(52) U.S. Cl.
CPC ..... *G04B 19/22* (2013.01); *G04B 13/00* (2013.01); *G04B 19/23* (2013.01); *G04G 9/0076* (2013.01)

(58) Field of Classification Search
CPC .... G04B 13/00; G04B 19/025; G04B 19/048; G04B 19/087; G04B 19/22; G04B 19/221;
(Continued)

(56) References Cited

U.S. PATENT DOCUMENTS 7,433,270 B2 * 10/2008 Chen ..... G04B 19/23 368/21
2005/0105397 A1 * 5/2005 Tuason ..... G04B 19/262 368/21
(Continued)

*Primary Examiner* — Edwin A. Leon
*Assistant Examiner* — Jason M Collins
(74) *Attorney, Agent, or Firm* — Law Office of Jerry Joseph, PLC; Jerry Joseph

(57) ABSTRACT

A time display apparatus for indicating time in a plurality of time zones simultaneously, the apparatus includes a case having a compartment enclosed by a cover, the case having a dial member indicating a 12-hour time clock and a 24-hour time clock, a first wheel completing one revolution in 12 hours and coupled to an hour hand, a second wheel completing one revolution in 1 hour and coupled to a multi-zone minute hand having at least two different vertices, and a third wheel completing one revolution in 24 hours and coupled to a multi-zone hour indicator hand having at least two different indicators, wherein each vertex of the multi-zone minute hand indicates a different minute marking on the 12 hour time clock and each indicator of the multi-zone hour indicator hand indicates a different hour marking on the 24 hour time clock corresponding to different time zones.

19 Claims, 7 Drawing Sheets

(51) Int. Cl.
*G04B 19/23* (2006.01)
*G04G 9/00* (2006.01)

(58) Field of Classification Search
CPC ... G04B 19/223; G04B 19/225; G04G 9/0076
See application file for complete search history.

(56) References Cited

U.S. PATENT DOCUMENTS

| | | | | |
|---|---|---|---|---|
| 2009/0207699 | A1* | 8/2009 | Buttet | G04B 19/23 368/21 |
| 2011/0151415 | A1* | 6/2011 | Darling | G09B 29/005 434/149 |
| 2013/0329529 | A1* | 12/2013 | Greubel | G04B 19/087 368/21 |

* cited by examiner

100

TIME DISPLAY APPARATUS FOR MULTIPLE TIME ZONES

BACKGROUND OF THE INVENTION

1. Field of the Invention

The present general inventive concept relates to time measuring devices and systems, and more particularly, to a time measuring device (e.g., automatic or mechanical watch) designed to measure and display time in a plurality of different time zones, simultaneously.

2. Description of Related Art

There have previously been mechanical time display devices and watches that have been designed to be able to measure and display the time in different time zones, referred to as a GMT time piece. A GMT time piece uses a mechanism that allows a user to selectively display up to two different time zones at a time. The GMT time piece uses a twenty-four (24) hour GMT hand that is used to track a secondary time zone. However, conventional GMT time piece devices are limited to being able to display whole hour GMT time zones. As a result, there is currently no time display device that accurately measures and displays times within 30- or 45-minute GMT offset time zones.

Therefore, what is desired is a time piece or watch that is designed to measure and display times in a plurality of different time zones, including whole hour, thirty minutes, and forty-five minutes GMT offset time zones, simultaneously.

SUMMARY OF THE INVENTION

The present general inventive concept provides a time piece, such as a watch, that is designed to display times in a plurality of different time zones, including whole hour, thirty minutes, and forty-five minutes GMT offset time zones, simultaneously.

The time display apparatus according to an example of the present general inventive concept displays three secondary time zones, as well as a primary time zone. The time display apparatus according to the present inventive concept is designed to represent whole number GMT time zones, for instance GMT +1, GMT +2, and GMT −5; thirty minute offset GMT time zones, for instance GMT +1:30, GMT +2:30, and GMT −5:30; and forty-five minute offset GMT time zones, for instance GMT +1:45, GMT +2:45, and GMT −5:45.

Aspects and/or features of the present general inventive concept is achieved by providing a time display apparatus for indicating time in a plurality of time zones simultaneously which includes a case having a compartment enclosed by a cover, the case having a dial member indicating a 12-hour time clock and a 24-hour time clock, a first wheel completing one revolution in 12 hours and coupled to an hour hand, a second wheel completing one revolution in 1 hour and coupled to a multi-zone minute hand having at least two different vertices and a third wheel completing one revolution in 24 hours and coupled to a multi-zone hour indicator hand having at least two different indicators, wherein each vertex of the multi-zone minute hand indicates a different minute marking on the 12-hour time clock and each indicator of the multi-zone hour indicator hand indicates a different hour marking on the 24 hour time clock corresponding to different time zones.

The multi-zone minute hand may include a first time zone vertex pointing to a first minute on the dial member and a second time zone vertex pointing to a different second minute on the dial member.

The first time zone vertex may indicate a first GMT offset minute and the second time zone vertex indicates a second GMT offset minute.

The second minute on the dial member pointed to by the second time zone vertex may be 30 minutes more than the first minute on the dial member pointed to by the first time zone vertex.

The multi-zone hour indicator hand may include a first indicator and a different second indicator, each indicator pointing to a different hour position on the 24-hour time clock.

The second indicator on the multi-zone hour indicator hand may indicate a marking on the 24 hour clock that is 30 minutes more than the first indicator.

The first indicator may include a first color and the second indicator includes a different second color.

The first indicator may be formed in a first shape, the second indicator is formed in a different second shape.

A time in a first time zone may be read using an hour marking indicated on the 12-hour time clock by the hour hand and a minute marking indicated on the 12 hour time clock by the first time zone vertex of the multi-zone minute hand.

A time in a second time zone may be read using an hour marking indicated on the 24-hour time clock by the first indicator of the multi-zone hour indicator hand and a minute marking indicated on the 12 hour time clock by the first time zone vertex of the multi-zone minute hand.

The multi-zone minute hand may further include a third time zone vertex indicating a third GMT offset pointing to a different third minute on the 12 hour time clock.

The third minute on the 12 hour time clock pointed to by the third time zone vertex may be 15 minutes more than the second minute on the 12 hour time clock pointed to by the second time zone vertex.

The multi-zone minute hand may be formed in a triangular shape. However, the present general inventive concept is not limited thereto.

The plurality of indicators may further include a different third indicator indicating a different hour position than the first and second indicators on the 24-hour time clock.

A time in a third time zone may be read using an hour marking indicated on the 24 hour time clock by the second indicator of the multi-zone hour indicator hand and a minute marking indicated on the 12 hour time clock by the second time zone vertex of the multi-zone minute hand.

A time in a fourth time zone may be read using an hour marking indicated on the 24 hour time clock by the third indicator of the multi-zone hour indicator hand and a minute marking indicated on 12 hour time clock by the third time zone vertex of the multi-zone minute hand.

Aspects and/or features of the present general inventive concept is also achieved by providing a time display apparatus for indicating time in a plurality of time zones simultaneously, the apparatus includes a case having a compartment enclosed by a cover, the case having a dial member indicating a 12-hour time clock, a bezel coupled to the case indicating a 24-hour time clock, a first wheel completing one revolution in 12 hours and coupled to an hour hand, a second wheel completing one revolution in 1 hour and coupled to a multi-zone minute hand having at least two different vertices, and a third wheel completing one revolution in 24 hours and coupled to a multi-zone hour indicator hand having at least two different indicators, wherein each vertex of the multi-zone minute hand indicates a different minute marking on the 12 hour time clock and each indicator of the multi-zone hour indicator hand indicates a different hour marking on the 24 hour time clock corresponding to different time zones.

BRIEF DESCRIPTIONS OF THE DRAWINGS

These and/or other aspects of the present general inventive concept will become apparent and more readily appreciated from the following description of the embodiments, taken in conjunction with the accompanying drawings of which:

DESCRIPTION OF INVENTION

Figure 1:
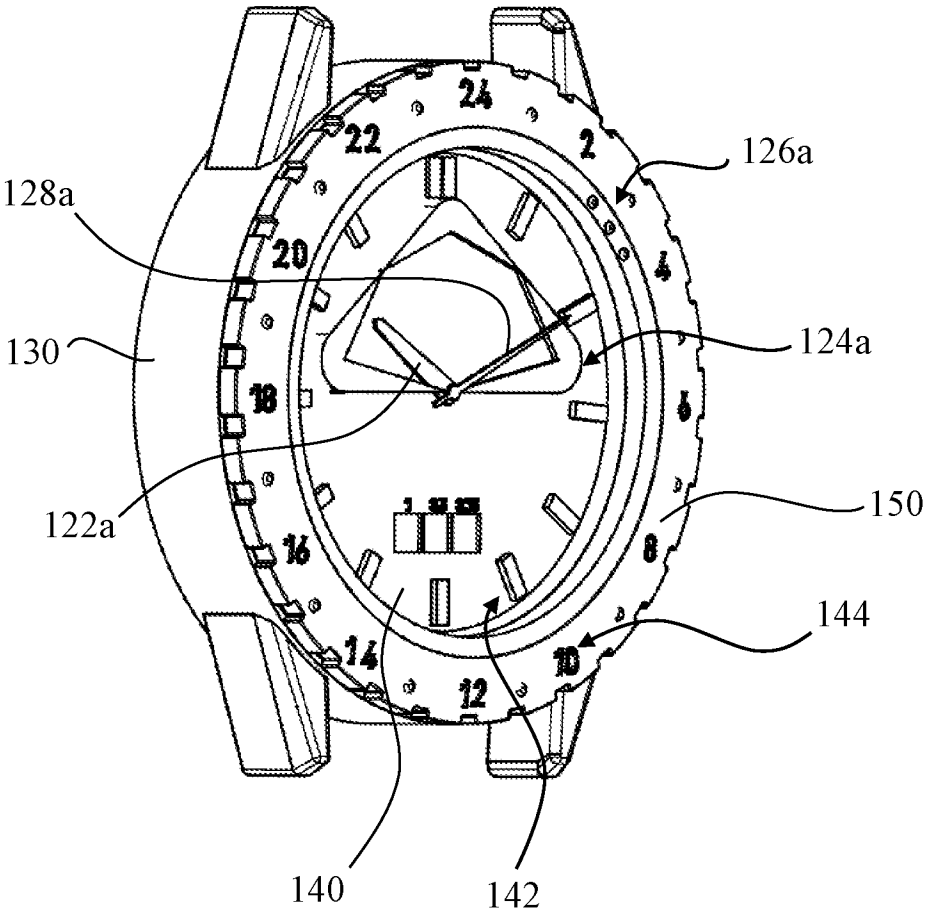
FIG. 1 is a perspective schematic view of a GMT time display apparatus according to an example embodiment of the present inventive concept.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

According to an example embodiment of the present general inventive concept, the GMT time display apparatus is designed and configured for indicating time in a plurality of different time zones, simultaneously.

Figure 2:
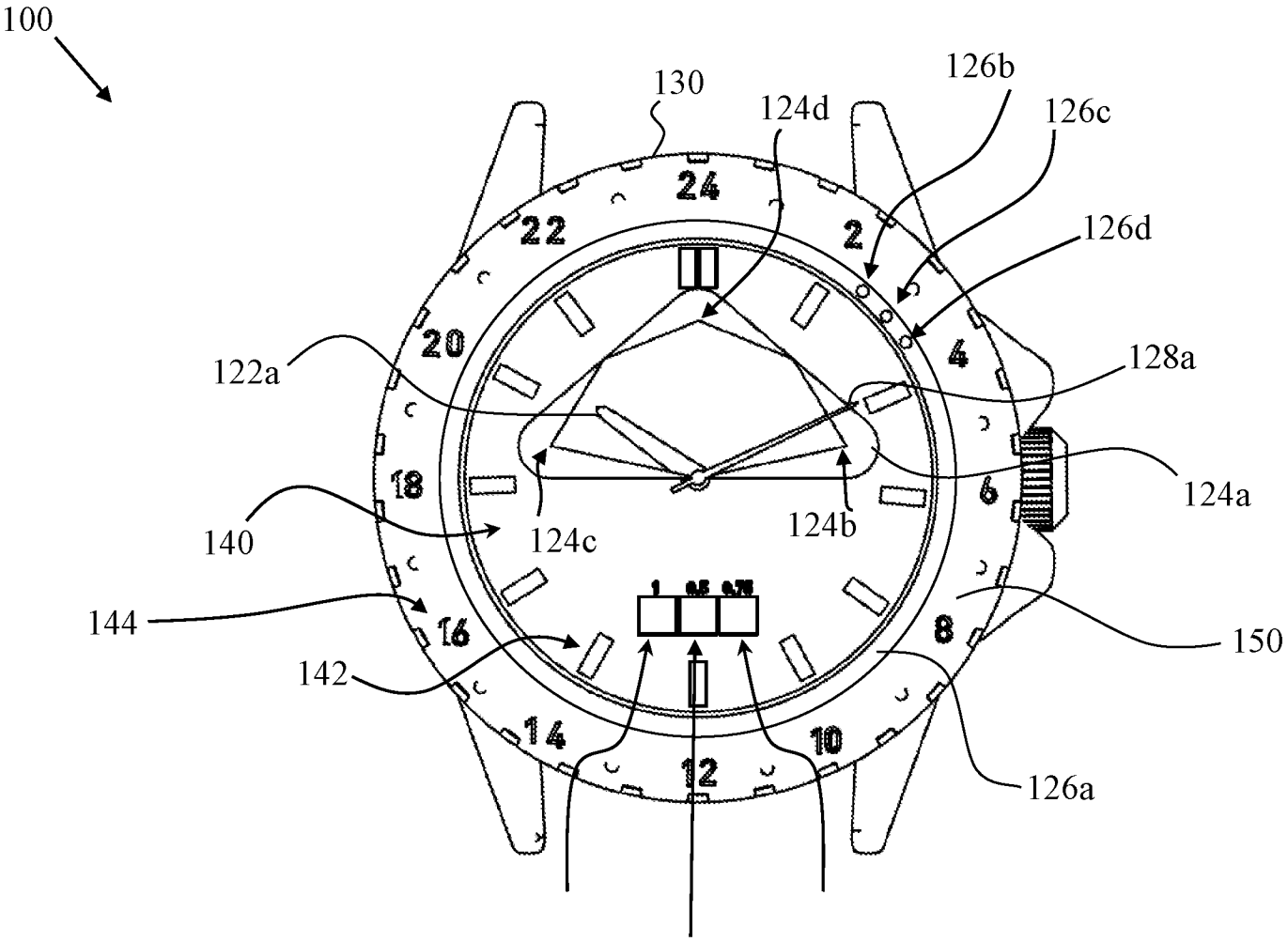
FIG. 2 is a top plan schematic view of the GMT time display apparatus illustrated in FIG. 1.
Figure 3:
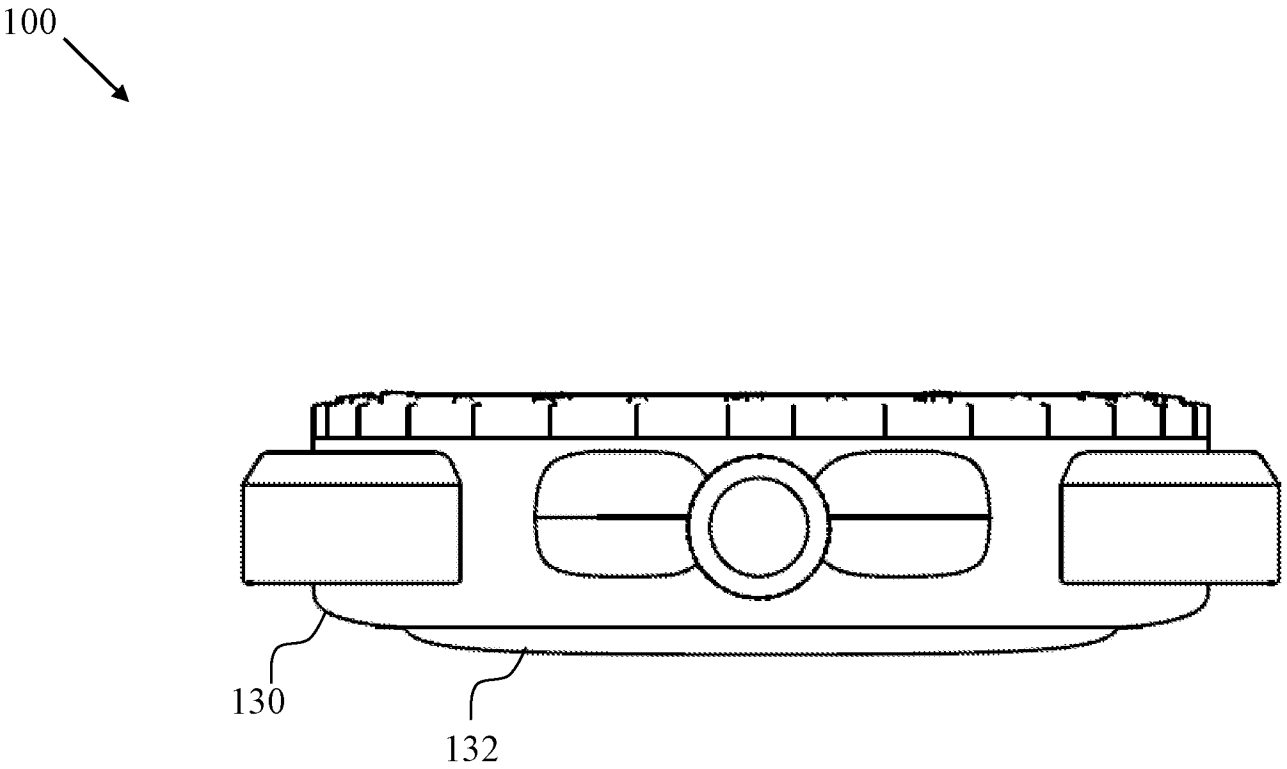
FIG. 3 is a side schematic view of the GMT time display apparatus illustrated in FIG. 2.
Figure 4:
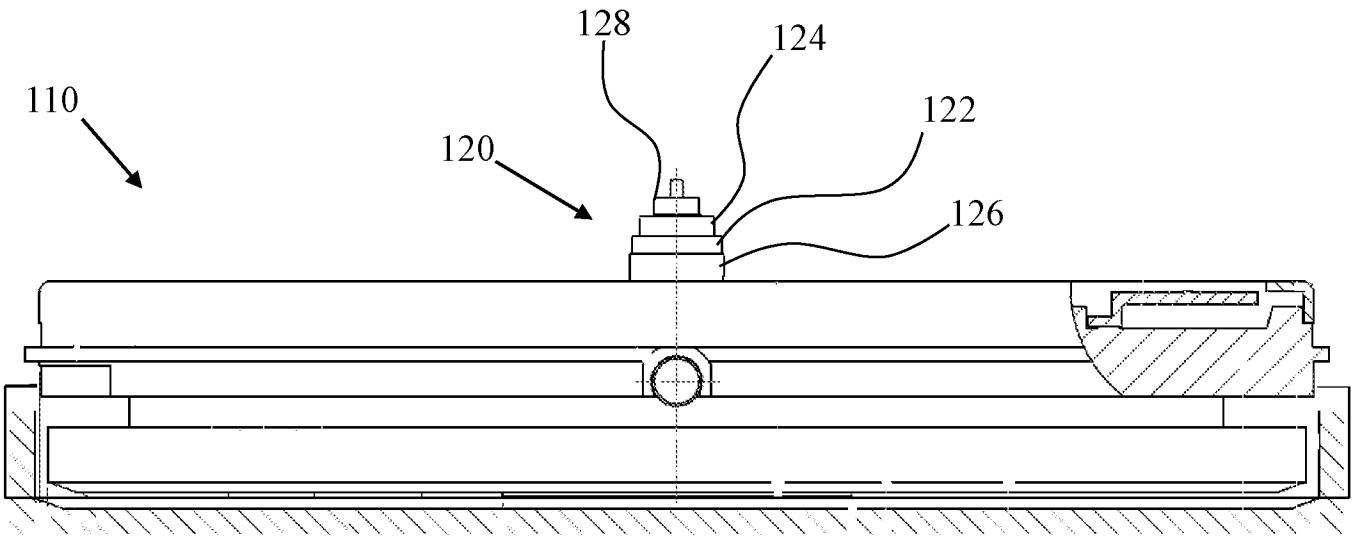
FIG. 4 is a side schematic view of an internal time measuring mechanism.

FIG. 1 is a perspective schematic view of a GMT time display apparatus 100 according to an example embodiment of the present inventive concept, FIG. 2 is a top plan schematic view of the GMT time display apparatus illustrated in FIG. 1, and FIG. 3 is a side schematic view of the GMT time display apparatus illustrated in FIG. 2. FIG. 4 is a side schematic view of an internal time measuring mechanism 110.

Referring to FIGS. 1 through 6, the time display apparatus or GMT time display apparatus, designated generally as 100, is illustrated. In the present embodiment, the GMT time display apparatus 100 is designed and configured to measure and display time in a plurality of different time zones, at the same time. The GMT time display apparatus 100 includes a time measuring mechanism 110 having a plurality of time measuring wheels 120 that are rotatably coupled within a case 130 and enclosed by a cover 132.

In the present embodiment, the case 130 includes a dial member 140 which indicates a 12-hour time clock 142 and a 24-hour time clock 144. The 12-hour time clock 142 and/or the 24-hour time clock 144 may be printed, embossed, or otherwise indicated on the dial member 140. However, the present general inventive concept is not limited thereto. That is, in alternative embodiments, the 24-hour time clock 144 may be indicated on a separate bezel 150 that is rotatably coupled to the case 130.

For illustration purposes, the present general inventive concept is described herein wherein the 12-hour time clock 142 is illustrated on the dial member 140 and the 24-hour time clock 144 is indicated on the bezel 150. However, the present general inventive concept is not limited thereto.

In the present embodiment, the time measuring mechanism 110 within the case 130 includes a first wheel 122 that is designed and configured to complete one revolution in 12 hours and is coupled to an hour hand 122*a*, a second wheel 124 that is designed and configured to complete one revolution in 1 hour and is coupled to a multi-zone minute hand 124*a*, a third wheel 126 that is designed and configured to complete one revolution in 24 hours and is coupled to a multi-zone hour indicator or hand 126*a*, and a fourth wheel 128 that is designed and configured to complete one revolution in 1 minute and is coupled to a seconds hand 128*a*.

In other words, the hour hand 122*a* makes two complete revolutions around the dial member 140 during a given 24-hour day, while the GMT multi-zone hour indicator hand 126*a* makes one complete revolution around the dial member 140 during the given 24-hour day.

In the present embodiment, the hour hand 122*a* indicates an hour on the 12-hour time clock 142 as the first wheel 122 of the time measuring mechanism 110 rotates.

In the present embodiment, the multi-zone minute hand 124*a* rotates while indicating two or more different minutes on the 12-hour time clock 142 as the second wheel 124 rotates. That is, the multi-zone minute hand 124*a* includes a first vertex 124*b* designed and configured to point at a first minute on the 12-hour time clock 142, a second vertex 124*c* designed and configured to point at a second minute on the 12-hour time clock 142, and a third vertex 124*d* designed and configured to point to a third minute on the 12-hour time clock 142. In the present embodiment, the first, second, and third minutes correspond to different GMT offsets and are different than each other.

For instance, in the present embodiment, the second vertex 124*c* points to a minute that is 30 minutes greater than the first vertex 124*b* and the third vertex 124*d* points to a minute that is 15 minutes greater than the second vertex 124*c*.

In the present embodiment, the multi-zone minute hand 124*a* may be formed in a substantially triangular shape. However, the present general inventive concept is not limited thereto. That is, in alternative embodiments, the multi-zone minute hand 124*a* may be formed in various shapes designed to indicate two or more different minutes on the 12-hour time clock 142.

In the present embodiment, the multi-zone hour indicator 126*a* rotates while indicating two or more different hours on the 24-hour time clock 144 as the third wheel 126 of the (GMT) time measuring mechanism 110 rotates.

As such, after a user initially sets a position of the multi-zone hour indicator hand 126*a* based upon a desired GMT offset, the time measuring mechanism 110 rotates the multi-zone hour indicator hand 126*a* half as fast as the hour hand 122*a*.

In the present embodiment, the multi-zone hour indicator hand 126*a* includes three distinct markers 126*b*, 126*c*, 126*d*, each represented by a distinct shape or color. In the present embodiment, the multi-zone hour indicator 126*a* may be formed as a rotatable ring or hand. However, the present general inventive concept is not limited thereto.

In alternative embodiments, the multi-zone hour indicator 126*a* is designed to have at least two indicators designed to indicate a different hour on the 24-hour time clock 144.

However, the present general inventive concept is not limited thereto.

In the present embodiment, the multi-zone hour indicator hand 126*a* is formed as a hand that is rotatable with respect to the dial member 140 and the bezel member 150 and is mechanically coupled to the third wheel 126 of the time measuring mechanism 110. However, the present general inventive concept is not limited thereto.

That is, in alternative embodiments, the multi-zone hour indicator 126*a* may be formed as a ring that rotates with respect to the dial member 140 and the bezel member 150 and is mechanically coupled to the third wheel 126 of the time measuring mechanism 110.

In the present embodiment, the seconds hand 128*a* indicates a second on the 12-hour time clock 142 as the fourth wheel 128 of the time measuring mechanism 110 rotates.

In alternative embodiments, the present general inventive concept may function with various other types of GMT movements having three wheels, wherein a first wheel completes one revolution in one-hour, a second wheel completes one revolution in 12-hours, and a third wheel completes one revolution in 24-hours.

In the present embodiment, each vertex of the multi-zone minute hand 124*a* indicates a different minute marking on the 12-hour time clock 142 and each indicator of the multi-zone hour indicator hand 126*a* indicates a different hour marking on the 24 hour time clock 144 corresponding to different time zones.

In alternative embodiments, the multi-zone hour indicator hand 126*a*, having the three distinct markers 126*b*, 126*c*, 126*d*, may be designed as isolated dots on a ring that rotates around the dial member 140. Each of the three distinct markers 126*b*, 126*c*, 126*d* corresponds with a specific vertex of the multi-time zone minute hand 124*a*.

For example, the first vertex 124*b* includes a first color (e.g., blue) or a first shape and the first distinct marker 126*b* includes the same first color (e.g., blue) and/or the first shape. Similarly, the second vertex 124*c* includes a second color (e.g., orange) or a second shape and the second distinct marker 126*c* includes the same second color (e.g., orange) and/or the second shape. Again similarly, the third vertex 124*d* includes a third color (e.g., white) or a third shape and the third distinct marker 126*d* includes the same third color (e.g., white) and/or third shape.

The GMT time display apparatus 100 according to the present embodiment includes three distinct GMT markers 126*b*, 126*c*, and 126*d* which may be embodied as a separate and distinct hand member or dots, as discussed above. The first distinct marker 126*b* indicates a whole number GMT offset hour, the second distinct marker 126*c* indicates a thirty-minute GMT offset hour, and the third distinct marker 126*d* indicates a forty-five minute GMT offset hour.

In the present embodiment, the three vertices of the multi time zone minute hand 124*a* each represent a minute marking for the three distinct GMT offsets. In particular, the first vertex 124*b* corresponds with the first distinct marker 126*b*; the second vertex 124*c* corresponds with the second distinct marker 126*c*; and the third vertex 124*d* corresponds with the third distinct marker 126*d*. As such, for GMT functionality, the three vertices of the multi time zone minute hand 124*a* represent the minute markings for each of the three GMT offset hours, respectively.

In alternative embodiments, the multi-zone minute hand 124*a* includes a first time zone vertex 124*b* pointing to a first minute on the dial member 140 and a second time zone vertex 124*c* pointing to a different second minute on the dial member 140. As such, the first time zone vertex 124*b* indicates a first GMT offset minute and the second time zone vertex 124*c* indicates a second GMT offset minute. For instance, the second minute on the dial member 140 pointed to by the second time zone vertex 124*c* is 30 minutes more than the first minute on the dial member pointed to by the first time zone vertex 124*b*. However, the present general inventive concept is not limited thereto.

In alternative embodiments, the multi-zone hour indicator 126*a* includes a first indicator 126*b* and a different second indicator 126*c*, each indicator pointing to a different hour position on the 24-hour time clock 144. For instance, the second indicator 126*c* on the multi-zone hour indicator 126*a* indicates a marking on the 24-hour clock that is 30 minutes more than the first indicator 126*b*.

In further alternative embodiments, the first indicator 126*b* includes a first color and the second indicator 126*c* includes a different second color. However, the present general inventive concept is not limited thereto. That is, in alternative embodiments, the first indicator 126*b* may be formed in a first shape and the second indicator 126*c* may formed in a different second shape.

In the present embodiment, a time in a first time zone is read using an hour marking indicated on the 12-hour time clock by the hour hand 122*a* and a minute marking indicated on the 12 hour time clock 142 by the first time zone vertex 124*b* of the multi-zone minute hand 124*a*.

Similarly, a time in a second time zone is read using an hour marking indicated on the 24-hour time clock by the first indicator 126*b* of the multi-zone hour indicator 126*a* and a minute marking indicated on the 12-hour time clock by the first time zone vertex 124*b* of the multi-zone minute hand 124*a*.

In alternative embodiments, the multi-zone minute hand 124*a* may include a third time zone vertex 124*d* indicating a third GMT offset that points to a different third minute on the 12-hour time clock 142. For instance, the third minute on the 12-hour time clock 142 pointed to by the third time zone vertex 124*d* is 15 minutes greater than the second minute on the 12-hour time clock 142 pointed to by the second time zone vertex. As such, the multi-zone minute hand may be formed in a substantially triangular shape. However, the present general inventive concept is not limited thereto.

In further alternative embodiments, the plurality of multi-zone hour indicators may further include a different third indicator 126*d* indicating a different hour position than the first and second indicators 126*b*, 126*c* on the 24-hour time clock 144. As such, a time in a third time zone is read using an hour marking indicated on the 24 hour time clock 144 by the second indicator 126*c* of the multi-zone hour indicator 126*a* and a minute marking indicated on the 12 hour time clock 142 by the second time zone vertex 124*c* of the multi-zone minute hand 124*a*.

Similarly, a time in a fourth time zone is read using an hour marking indicated on the 24-hour time clock 144 by the third indicator 126*d* of the multi-zone hour indicator 126*a* and a minute marking indicated on 12-hour time clock 142 by the third time zone vertex 124*d* of the multi-zone minute hand 124*a*. However, the present general inventive concept is not limited thereto.

Figure 5:
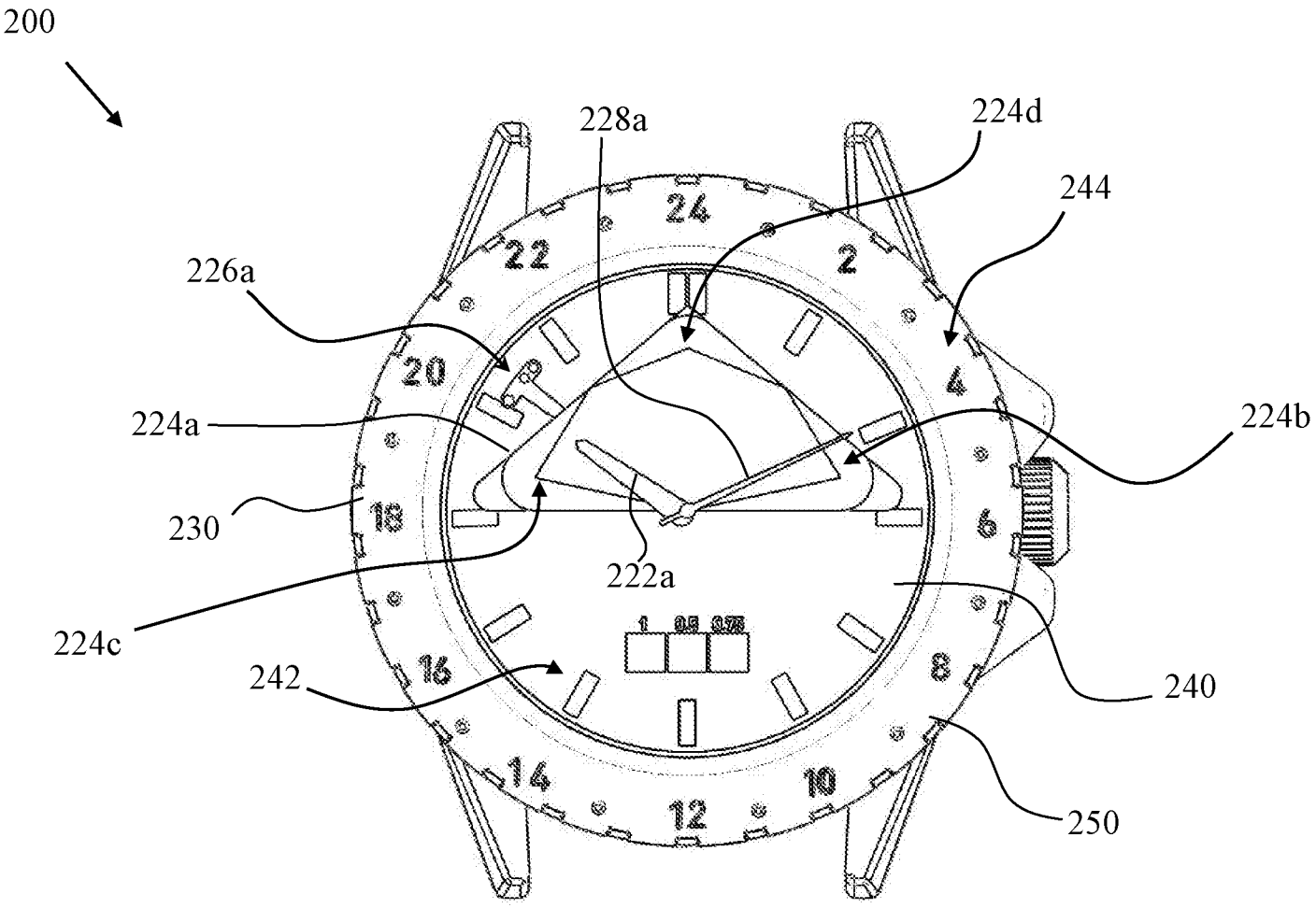
FIG. 5 is a top plan view of a GMT time display apparatus according to another embodiment of the present inventive concept.
Figure 6:
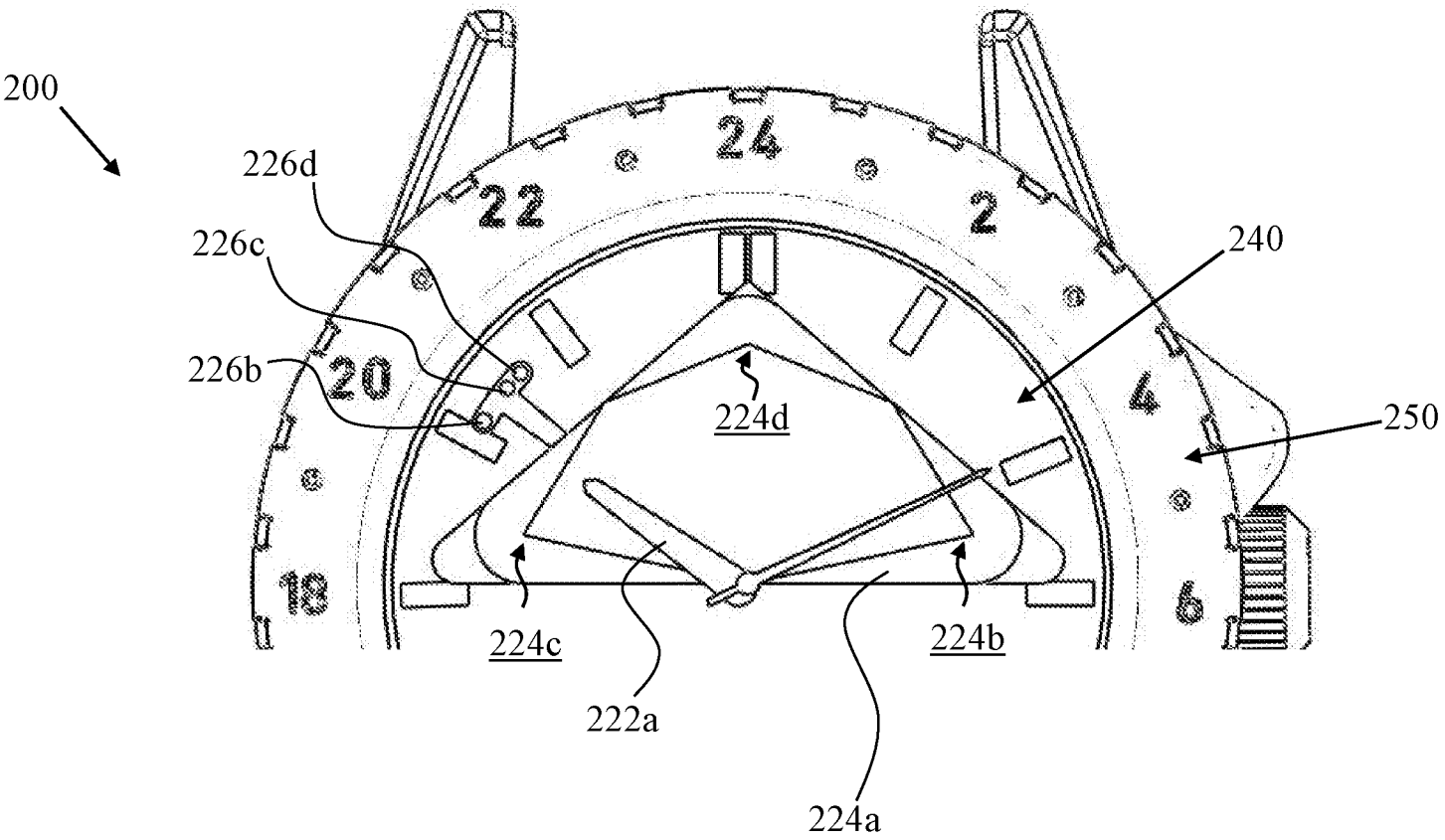
FIG. 6 is an enlarged top plan view of the GMT time display apparatus illustrated in FIG. 5.

FIG. 5 is a top plan view of a GMT time display apparatus 200 according to another embodiment of the present inventive concept and FIG. 6 is an enlarged top plan view of the GMT time display apparatus 200 illustrated in FIG. 5.

Referring to FIGS. 5 and 6, the GMT time display apparatus 200 according to the present embodiment is similar to the previous embodiment, except the multi-zone hour indicator 226*a* is embodied as a hand member.

Referring to FIG. 5, the time display apparatus or GMT time display apparatus, designated generally as 200, is illustrated. In the present embodiment, the GMT time display apparatus 200 is designed and configured to measure and display time in a plurality of different time zones, at the same time. The GMT time display apparatus 200 includes a time measuring mechanism 110 having plurality of time measuring wheels 120 that are rotatably coupled within a case 230 and enclosed by a cover. (See FIG. 4). The present embodiment includes the same time measuring mechanism 110 illustrated in the previous embodiment.

In the present embodiment, the case 230 includes a dial member 240 which indicates a 12-hour time clock 242 and a 24-hour time clock 244. The 12-hour time clock 242 and/or the 24-hour time clock 244 may be printed, embossed, or otherwise indicated on the dial member 140. However, the present general inventive concept is not limited thereto. That is, in alternative embodiments, the 24-hour time clock 244 may be indicated on a separate bezel 250 that is rotatably coupled to the case 230.

For illustration purposes, the present general inventive concept is described herein wherein the 12-hour time clock 242 is illustrated on the dial member 240 and the 24-hour time clock 244 is indicated on the bezel 250. However, the present general inventive concept is not limited thereto.

In the present embodiment, the time measuring mechanism within the case 230 includes a first wheel that is designed and configured to complete one revolution in 12 hours and is coupled to an hour hand 222*a*, a second wheel that is designed and configured to complete one revolution in 1 hour and is coupled to a multi-zone minute hand 224*a*, a third wheel that is designed and configured to complete one revolution in 24 hours and is coupled to a multi-zone hour indicator hand 226*a*, and a fourth wheel that is designed and configured to complete one revolution in 1 minute and is coupled to a seconds hand 228*a*.

In other words, the hour hand 222*a* makes two complete revolutions around the dial member 240 during a given 24-hour day, while the GMT multi-zone hour indicator hand 226*a* makes one complete revolution around the dial member 140 during the given 24-hour day.

Figure 7:
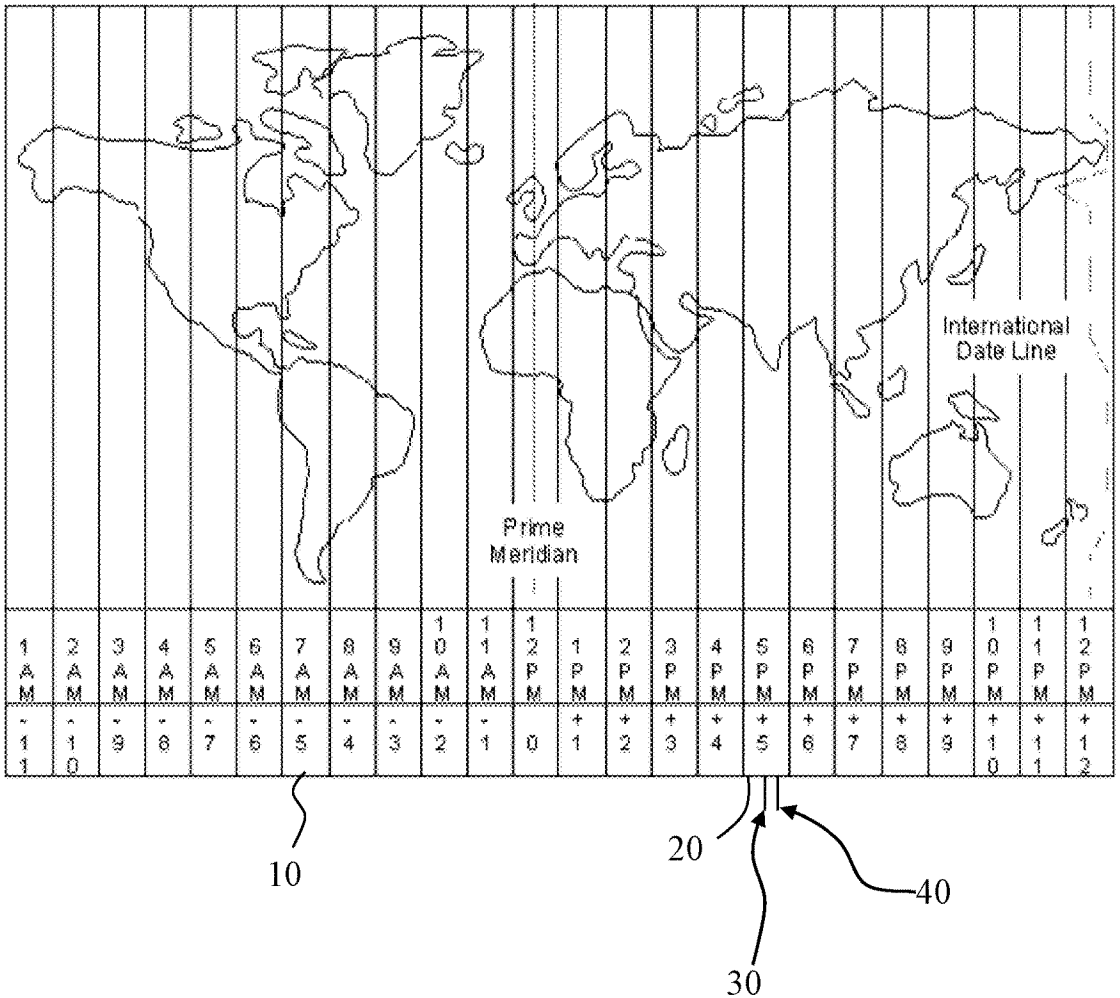
FIG. 7 illustrates a Greenwich Mean Time (GMT) time zone map.

FIG. 7 illustrates a Greenwich Mean Time (GMT) time zone map.

In operation, when set correctly to a desired time zone, the GMT time display apparatus 200 is designed to display the time within a first time zone 10 using the first hand member 222*a* to indicate a first time zone hour and the first vertex 224*b* of the multi-zone minute hand 224*a* to indicate a first time zone minute, both read using the dial member 240.

In addition, the GMT time display apparatus 200 is designed to display a whole hour offset GMT time in a second time zone 20 by using the first distinct marker 226*b* of the multi-zone hour indicator 226*a* to indicate an hour in a second time zone 20 using the 24 hour time clock 244 and the first vertex 224*b* to indicate a minute in the second time zone 20 using the 12 hour time clock 242 on dial member 240.

Similarly, the GMT time display apparatus 200 is designed to display a thirty minute offset GMT time in a third time zone 30 by using the second distinct marker 226*c* of the multi-zone hour indicator hand or ring 226*a* to indicate an hour in the third time zone 30 using the 24 hour time clock 244 and the second vertex 224*c* to indicate a minute in the third time zone 30 using the 12 hour time clock 242 on dial member 240.

Also, the GMT time display apparatus 200 is designed to display a forty-five minute offset GMT time in a fourth time zone 40 by using the third distinct marker 226*d* of the multi-zone hour indicator 226*a* to indicate an hour in the fourth time zone 40 using the 24 hour time clock 244 to obtain the hour and the third vertex 224*d* to indicate a minute in the fourth time zone 40 using the 12 hour time clock 242 on dial member 240.

In other words, a user may initially set a position of the multi-zone hour indicator hand 226*a* to a desired GMT offset hour. Once set, the time measuring mechanism within the GMT time display apparatus 200 rotates the multi-zone hour indicator 226*a* one complete revolution per a 24 hour day.

In an example, in the case where the first time zone 10 has a GMT offset of −5, the second time zone 20 has a GMT offset of +5, the third time zone 30 has a GMT offset of +5:30, and the fourth time zone 40 has a GMT offset of +5:45. The time in the first time zone 10 is 10:15 AM, which is read by using the first hand member 222*a* and the 12 hour time clock 242 on dial member 240 to indicate the hour and the first vertex 224*b* and the 12 hour time clock 242 on dial member 240 to indicate the minute.

The time in the second time zone 20 is 20:15 PM, which is read by using the first distinct marker 226*b* and the 24-hour time clock 244 to indicate the hour and the first vertex 224*b* and the 12 hour time clock 242 on dial member 240 to indicate the minute.

Similarly, the time in the third time zone 30 is 20:45 PM, which is read by using the second distinct marker 226*c* and the 24 hour time clock 244 to indicate the hour and the second vertex 224*c* and the 12 hour time clock 242 on dial member 240 to indicate the minute.

Similarly, the time in the fourth time zone 40 is 21:00 PM, which is read by using the third distinct marker 226*d* and the 24 hour time clock 244 to indicate the hour and the third vertex 224*d* and the 12 hour time clock 242 on dial member 240 to indicate the minute.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A time display apparatus for indicating time in a plurality of time zones simultaneously, the apparatus comprising:

a case having a compartment enclosed by a cover, the case comprising:

a dial member indicating a 12-hour time clock and a 24-hour time clock;

a first wheel completing one revolution in 12 hours and coupled to an hour hand;

a second wheel completing one revolution in 1 hour and coupled to a multi-zone minute hand having at least two different vertices; and a third wheel completing one revolution in 24 hours and coupled to a multi-zone hour indicator hand having at least two different indicators, wherein each vertex of the multi-zone minute hand indicates a different minute marking on the 12-hour time clock and each indicator of the multi-zone hour indicator hand indicates a different hour marking on the 24 hour time clock corresponding to different time zones.

2. The time display apparatus of claim 1, wherein the multi-zone minute hand includes a first time zone vertex pointing to a first minute on the dial member and a second time zone vertex pointing to a different second minute on the dial member.

3. The time display apparatus of claim 2, wherein the first time zone vertex indicates a first GMT offset minute and the second time zone vertex indicates a second GMT offset minute.

4. The time display apparatus of claim 3, wherein the second minute on the dial member pointed to by the second time zone vertex is 30 minutes more than the first minute on the dial member pointed to by the first time zone vertex.

5. The time display apparatus of claim 2, wherein the multi-zone hour indicator hand includes a first indicator and a different second indicator, each indicator pointing to a different hour position on the 24-hour time clock.

6. The time display apparatus of claim 5, wherein the second indicator on the multi-zone hour indicator hand indicates a marking on the 24 hour clock that is 30 minutes more than the first indicator.

7. The time display apparatus of claim 6, wherein a time in a first time zone is read using an hour marking indicated on the 12-hour time clock by the hour hand and a minute marking indicated on the 12 hour time clock by the first time zone vertex of the multi-zone minute hand.

8. The time display apparatus of claim 7, wherein the plurality of indicators further includes a different third indicator indicating a different hour position than the first and second indicators on the 24-hour time clock.

9. The time display apparatus of claim 6, wherein a time in a second time zone is read using an hour marking indicated on the 24-hour time clock by the first indicator of the multi-zone hour indicator hand and a minute marking indicated on the 12 hour time clock by the first time zone vertex of the multi-zone minute hand.

10. The time display apparatus of claim 9, wherein a time in a third time zone is read using an hour marking indicated on the 24 hour time clock by the second indicator of the multi-zone hour indicator hand and a minute marking indicated on the 12 hour time clock by the second time zone vertex of the multi-zone minute hand.

11. The time display apparatus of claim 10, wherein a time in a fourth time zone is read using an hour marking indicated on the 24 hour time clock by the third indicator of the multi-zone hour indicator hand and a minute marking indicated on 12 hour time clock by the third time zone vertex of the multi-zone minute hand.

12. The time display apparatus of claim 6, wherein the multi-zone minute hand further comprises a third time zone vertex indicating a third GMT offset pointing to a different third minute on the 12 hour time clock.

13. The time display apparatus of claim 12, wherein the third minute on the 12 hour time clock pointed to by the third time zone vertex is 15 minutes more than the second minute on the 12 hour time clock pointed to by the second time zone vertex.

14. A time display apparatus for indicating time in a plurality of time zones simultaneously, the apparatus comprising:

a case having a compartment enclosed by a cover, the case comprising:

a dial member indicating a 12-hour time clock;

a bezel coupled to the case indicating a 24-hour time clock;

a first wheel completing one revolution in 12 hours and coupled to an hour hand;

a second wheel completing one revolution in 1 hour and coupled to a multi-zone minute hand having at least two different vertices; and a third wheel completing one revolution in 24 hours and coupled to a multi-zone hour indicator hand having at least two different indicators, wherein each vertex of the multi-zone minute hand indicates a different minute marking on the 12 hour time clock and each indicator of the multi-zone hour indicator hand indicates a different hour marking on the 24 hour time clock corresponding to different time zones.

15. The time display apparatus of claim 14, wherein the multi-zone minute hand includes a first time zone vertex pointing to a first minute on the dial member, a second time zone vertex pointing to a different second minute on the dial member, and a third time zone vertex pointing to a different third minute on the dial member.

16. The time display apparatus of claim 15, wherein the first time zone vertex indicates a first GMT offset minute, the second time zone vertex indicates a second GMT offset minute, and the third time zone vertex indicates a third GMT offset minute.

17. The time display apparatus of claim 16, wherein the second minute on the dial member pointed to by the second time zone vertex is 30 minutes more than the first minute on the dial member pointed to by the first time zone vertex and the third minute on the dial member pointed to by the third time zone vertex is 45 minutes more than the first minute on the dial member pointed to by the first time zone vertex.

18. The time display apparatus of claim 17, wherein the multi-zone hour indicator hand includes a first indicator, a second indicator, and a third indicator, each indicator pointing to a different hour position on the 24-hour time clock.

19. The time display apparatus of claim 18, wherein the second indicator on the multi-zone hour indicator hand indicates a marking on the 24 hour clock that is 30 minutes more than the first indicator and the third indicator indicates a marking on the 24 hour clock that is 45 minutes more than the first indicator.

* * * * *